US011413624B2

(12) United States Patent
Gnam et al.

(10) Patent No.: US 11,413,624 B2
(45) Date of Patent: Aug. 16, 2022

(54) DRIVE SYSTEM FOR OPERATING A CRUSHER AND METHOD FOR OPERATING A CRUSHER

(71) Applicant: Kleemann GmbH, Göppingen (DE)

(72) Inventors: Michael Gnam, Blaubeuren (DE); Manuel Amann, Esslingen am Neckar (DE); Gerald Ebel, Göppingen (DE); Otto Blessing, Bartholomä (DE)

(73) Assignee: Kleemann GmbH

( * ) Notice: Subject to any disclaimer, the term of this patent is extended or adjusted under 35 U.S.C. 154(b) by 227 days.

(21) Appl. No.: 16/756,877

(22) PCT Filed: Jul. 12, 2018

(86) PCT No.: PCT/EP2018/068911

§ 371 (c)(1),
(2) Date: Apr. 17, 2020

(87) PCT Pub. No.: WO2019/081079

PCT Pub. Date: May 2, 2019

(65) Prior Publication Data

US 2021/0239144 A1 Aug. 5, 2021

(30) Foreign Application Priority Data

Oct. 25, 2017 (DE) ..... 10 2017 124 961.3

(51) Int. Cl.
*B02C 23/04* (2006.01)
*B02C 13/30* (2006.01)
(Continued)

(52) U.S. Cl.
CPC ..... *B02C 23/04* (2013.01); *B02C 13/30* (2013.01); *B02C 13/31* (2013.01); *B02C 17/24* (2013.01); *B02C 18/24* (2013.01); *B02C 25/00* (2013.01)

(58) Field of Classification Search
CPC ..... B02C 13/30; B02C 13/31; B02C 4/42; B02C 25/00; B02C 17/24; B02C 18/24; B02C 23/04
See application file for complete search history.

(56) References Cited

U.S. PATENT DOCUMENTS 6,666,312 B2 * 12/2003 Matranga ..... B63H 23/30 192/52.4
6,928,811 B2 8/2005 Yamamoto et al.
(Continued)

FOREIGN PATENT DOCUMENTS

CN 2173322 Y 8/1994
CN 1497197 A 5/2004
(Continued)

OTHER PUBLICATIONS

International Search Report for corresponding PCT/EP2018/068911, dated Oct. 19, 2018, 11 pages (not prior art).
(Continued)

*Primary Examiner* — Faye Francis
(74) *Attorney, Agent, or Firm* — Lucian Wayne Beavers; Patterson Intellectual Property Law

(57) ABSTRACT

A drive system for driving a crusher of a material crusher plant having a main drive and a power transfer unit driven by the main drive, wherein the power transfer unit drives at least one generator and a first hydraulic pump which is connected to the power transfer unit in a shiftable manner. It is provided that a shiftable fluid coupling is installed in the transmission path from the power transfer unit to the crusher, that the shiftable fluid coupling and a pump are interconnected in a fluid conveying manner in a pump circuit and that a fluid can be supplied to the shiftable fluid coupling by means of the pump. A method of operating such a crusher is also provided.

17 Claims, 3 Drawing Sheets

(51) Int. Cl.

| | |
|---|---|
| ***B02C 13/31*** | (2006.01) |
| ***B02C 25/00*** | (2006.01) |
| ***B02C 17/24*** | (2006.01) |
| ***B02C 18/24*** | (2006.01) |

(56) References Cited

U.S. PATENT DOCUMENTS

| | | | |
|---|---|---|---|
| 7,322,454 | B2 | 1/2008 | Sato et al. |
| 2021/0069721 | A1* | 3/2021 | McCall ..... B02C 18/2216 |

FOREIGN PATENT DOCUMENTS

| | | | |
|---|---|---|---|
| CN | 1724900 | A | 1/2006 |
| DE | 9400147 | U1 | 3/1994 |
| DE | 102015118398 | A1 | 1/2016 |
| EP | 2500100 | A1 | 9/2012 |

OTHER PUBLICATIONS

India Office Action for corresponding patent application No. 202047017466, dated May 21, 2021, 5 pages (not prior art).

* cited by examiner

DRIVE SYSTEM FOR OPERATING A CRUSHER AND METHOD FOR OPERATING A CRUSHER

The invention relates to a drive system for driving a crusher of a material crusher plant having a main drive and a power transfer unit driven by the main drive, wherein the power transfer unit drives at least one generator and a first hydraulic pump, which is connected to the power transfer unit in a shiftable manner.

The invention further relates to a method for operating a crusher of a material crusher plant having a drive system driving the crusher, wherein the drive system comprises at least one main drive and a power transfer unit.

Such crushers are used in material crusher plants as mobile or stationary units for crushing, for instance, natural stone or recycled materials such as concrete, bricks, demolition rubble and the like. The material to be crushed to a specified size is fed into the crusher. The latter can be designed as an impact crusher. In such an impact crusher, the material to be crushed is seized by a fast-running rotor, accelerated and thrown onto a stationary impact mechanism until it has been crushed to the desired grain size. In a cone crusher, crushing is performed in a continuously opening and closing crushing gap between a crushing hopper and a crusher spindle. The crusher spindle rotates along an eccentric trajectory. Jaw crushers, in which the crushed material is crushed in a wedge-shaped slot between a fixed jaw and a crusher jaw moved by an eccentric shaft, are also used.

The high forces required to crush the material are a common feature of such crushers. Accordingly, they are of a mechanically stable design. As a result, large masses have to be moved with correspondingly large mass moments of inertia. The crushers are driven by powerful drives adapted to the crushers, if necessary with the interposition of a mechanical transmission. To enable the drive, which may be designed as a diesel engine for instance, to be ramped up, a clutch, for instance a frictional clutch, is provided between the drive and the crusher, which clutch can be used to interrupt and establish the torque and power transmission. The clutch can also be actuated in the event of a blockage of the crusher. Ramping up the crusher results in high mechanical and thermal stresses on the clutch when it is engaged and the speed of the crusher is slowly adapted to the speed of the drive or a transmission output shaft of an intermediate transmission.

DE 102015118398 A1 describes a drive device and a machine device plus a method for ramping up the drive device and the machine device. The machine may be a crusher driven by the drive device via a belt drive. A main drive designed, for instance, as a diesel engine is connected to a gearbox via a gearbox input shaft. A clutch is downstream of the transmission, which clutch is used to connect the transmission to the belt drive via a transmission output shaft. Actuating the clutch can interrupt or establish the flow of torque between the transmission input shaft and the transmission output shaft. The clutch can be engaged and disengaged, for instance, by hydraulic or pneumatic pressure, electromagnetic force, spring force or mechanical operation. An auxiliary drive, which is designed to drive the transmission output shaft is assigned to the drive device or the machine device. To ramp up the drive device or the machine device, the main drive can be started with a disengaged clutch and the speed increased to a specified value. Simultaneously, the auxiliary drive can accelerate the transmission shaft and thus the driven machine to a specified engagement speed. Upon achieving this speed, the clutch is engaged and the auxiliary drive is switched off. The machine is then driven by the main drive. Hydraulic pumps are connected to the transmission, either directly or via individual clutches, which are driven by the main drive via the transmission.

The auxiliary drive thus accelerates the high mass of the machine before it is coupled to the main drive. In this way, a high load on the clutch can be avoided when the clutch is engaged. A disadvantage is, however, that in addition to the main drive, a further drive (auxiliary drive) is mandatory. This results in an increased number of components and thus increased costs. Furthermore, space inside the machine device must be provided for the auxiliary drive, which is not always possible, particularly in the cramped confines of mobile machine devices.

From EP 2 500 100 A1, a drive device for a machine device and the associated machine device are known. The drive device comprises at least one drive means, a pump power transfer unit, a hydraulic pump, a fluid coupling and a v-belt pulley. The drive means drives the pump power transfer unit and, via that, the hydraulic pump and the v-belt pulley. A clutch and the fluid coupling are interposed between the pump power transfer unit and the v-belt pulley. The clutch is located upstream of the fluid coupling. The machine to be driven can be a crusher of a construction machine, for instance. The driven machine therefore has a high mass inertia. The clutch is used to interrupt or connect the flow of torque between a gearbox input shaft and a gearbox output shaft of the pump power transfer unit. It can be actuated by hydraulic or pneumatic pressure, by an electromagnetic force, a spring force or mechanical operation. The fluid coupling arranged in series with the clutch is based on the Föttinger principle. The fluid coupling results in the downstream components having a high mass inertia being accelerated gently putting only little stress on the clutch. The disadvantage of this arrangement is that two couplings are provided, to wit the clutch and the fluid coupling. This results in increased manufacturing costs in addition to higher operating costs and maintenance costs of the machine device.

The invention therefore addresses the problem of providing a drive system for a crusher, which, at a reduced number of required components, permits a gentle ramping-up of the crusher and an interruption of the transmission of torque and power.

The invention further addresses the problem of providing a corresponding process for operating a crusher.

The invention addresses a problem in relation to the drive system, which is solved by installing a shiftable fluid coupling in the transmission path from the power transfer unit to the crusher, by interconnecting the shiftable fluid coupling and a pump in a fluid conveying manner in a pump circuit and by supplying a fluid to the shiftable fluid coupling by means of the pump. Opening the shiftable fluid coupling interrupts the transmission of torque and power from the main drive to the crusher. In this way, the main drive can be started without power being transferred to the crusher. By engaging the shiftable fluid coupling, torque and/or power is transferred from the main drive to the crusher via the power transfer unit. In that way, the shiftable fluid coupling permits a smooth start of the crusher. The shiftable fluid coupling absorbs extreme load peaks and torsional vibrations. In case of overload or blockage situations, the shiftable fluid coupling can be rapidly opened. This results in an effective overload protection. In that way, the shiftable fluid coupling combines the advantages of a shiftable, frictional clutch and a non-shiftable fluid coupling downstream thereof, as known from the state of the art, in one component.

According to a particularly preferred design variant of the invention, provision may be made that the transmission of torque and/or power of the shiftable fluid coupling can be adjusted by adjusting the filling quantity of the fluid in the shiftable fluid coupling. Besides the pure shifting operation for the transmission of torque and power, the torque transmitted by the clutch can be specified without slippage or with minimum slippage by adjusting the fluid level in the shiftable fluid coupling accordingly. A higher fluid level permits the transmission of a greater torque.

Particularly preferably provision may be made that in a first operating state of the drive system, the volume flow of the fluid supplied to the fluid coupling is greater than the volume flow discharged, that in a second operating state of the drive system, the volume flows of the supplied and discharged fluid are identical and that in a third operating state, the volume flow supplied to the fluid coupling is smaller than the volume flow discharged. In doing so, the supply and the discharge of the fluid to and from the pump can also be completely interrupted. If the volume flow supplied to the fluid coupling is greater than the volume flow discharged, the fluid level inside the shiftable fluid coupling rises. This permits the shiftable fluid coupling to transmit a higher torque. If the volume flow supplied and the volume flow discharged are identical, the torque that can be transmitted by the fluid coupling remains unchanged. A volume flow of 0 $m^3$/min or volume flows differing from 0 $m^3$/min but being identical can be provided for the supplied and discharged volume flows. If the discharged volume flow is selected to be greater than the supplied volume flow, the transmissible torque can be reduced. The transmission of torque and/or power can be interrupted if the shiftable fluid coupling is completely or at least almost completely drained.

A simple and reliable interruption of the inflow or discharge of the fluid to or from the shiftable fluid coupling can be achieved by arranging at least one valve to interrupt the flow in the pump circuit of the fluid. If, for instance, it is intended that a valve is arranged in the supply line of the shiftable fluid coupling, the supply of the fluid to the shiftable fluid coupling can be interrupted. If the fluid continues to flow out of the shiftable fluid coupling, the level of the fluid inside the shiftable fluid coupling can be quickly reduced in this way, thereby reducing or interrupting the transmission of torque or power.

It can be advantageous to have the power transfer unit drive the pump or to have the main drive shaft drive the pump. In this way, the pump is driven continuously while the main drive is running, irrespective of the fluid level of the shiftable fluid coupling. In this way the fluid level of the fluid coupling can be adjusted in all operating situations in which the main drive is running. A pump driven by the power transfer unit is more accessible, simplifying installation and maintenance.

According to a preferred design of the invention, provision may be made that the shiftable fluid coupling has drilled holes, through which the fluid is routed out of the shiftable fluid coupling because of the centrifugal force present inside the shiftable fluid coupling and is subsequently routed to the pump. When the main drive and thus the shiftable fluid coupling is rotating, fluid is permanently discharged from the shiftable fluid coupling. The fluid level inside the shiftable fluid coupling can be adjusted by controlling the inflow of fluid.

To be able to increase the fluid level inside the shiftable fluid coupling, it can be provided that the delivery rate of the pump is greater than the volume flow through the drilled holes of the shiftable fluid coupling caused by the centrifugal force. In this way, the fluid level of the fluid can be increased inside the shiftable fluid coupling in spite of the permanent discharge of the fluid from the shiftable fluid coupling. By reducing the delivery rate of the pump, the fluid level inside the shiftable fluid coupling can be reduced. The flow of fluid to the shiftable fluid coupling can be particularly advantageously controlled or regulated by a valve located between the pump and the shiftable fluid coupling. The pump can then be operated at constant pumping capacity. The fluid level is adjusted by controlling or regulating the volume flow supplied to the shiftable fluid coupling by means of the valve. In the simplest case, a control valve having binary behavior can be provided, which can be moved between an open and a closed position. Opening the valve increases the fluid level in the shiftable fluid coupling and in that way its capability to transmit torque and power. By closing the valve, the fluid level is rapidly reduced in proportion to the discharge of fluid from the shiftable fluid coupling. This permits, for instance, a rapid interruption of the transmission of torque and/or power if the crusher is blocked. A control valve can be used to easily set a minimum and maximum level in the shiftable fluid coupling. It is also conceivable to set intermediate fluid levels and in that way a desired transmission capacity of torque and/or power of the shiftable fluid coupling based on an correspondingly clocked activation of the shifting valve.

It is also possible to provide a proportional valve in the conveying line between the pump and the shiftable fluid coupling. Such a proportional valve can be used to easily adjust the fluid level of the shiftable fluid coupling to maximum, minimum and intermediate levels.

Provision may be made to quickly interrupt the transmission of torque and/or power from the main drive to the crusher in the event of an overload or blockage of the crusher, thereby preventing the main drive from stalling or damage to the blocked components of the drive system or the crusher from occurring, in that a control unit is assigned to the drive system, and in that the control unit is designed to detect an overload and/or a blockage of the crusher and, in the event of a detected overload and/or blockage, to output a control signal, which causes the pump to be switched off and/or the supply of fluid to the shiftable fluid coupling to be interrupted.

A safe start of the main drive and a smooth ramping-up of the crusher can be achieved by designing the control unit to control the pump and/or the valve such that the filling quantity of the fluid in the shiftable fluid coupling increases when the rotational speed of the main drive is increased after the start thereof and/or when the rotational speed of the crusher is increased. The increase in the filling quantity continuously increases the transmission of torque and/or power of the shiftable fluid coupling, thereby reliably preventing an overload of the main drive. Preferably, the complete filling of the previously drained, shiftable fluid coupling is performed inside a period of 5 to 60 s, particularly preferably inside a period of 10 to 20 s.

To be able to drive further aggregates, for instance a hydraulic motor for moving a mobile material crusher unit, in which the drive unit and the crusher are integrated, provision may be made that at least one second hydraulic pump is connected to the power transfer unit in a non-shiftable manner and driven thereby.

Particularly advantageously, provision may be made that the drive system drives the crusher via a belt drive and that a drive pulley of the belt drive is connected to the shiftable fluid coupling of the drive system. The belt drive can transmit the torque or power from the power transfer unit to the crusher along a sufficiently great distance. It permits setting a suitable transmission ratio, compensates for impact loads and is easy to install and maintain. However, it is also conceivable to provide other transmission elements between the drive system and the crusher, such as a gear drive, chain drive, shaft or similar.

If it is intended to assign an auxiliary drive to the drive system, which auxiliary drive is directly or indirectly in operative connection to the crusher in the power transmission direction of the main drive downstream of the shiftable fluid coupling, then the crusher can be operated in the opposite direction to the work-flow direction, for instance in case of a blockage or for maintenance purposes. It is also conceivable to use the auxiliary drive to support the crusher during ramping-up.

A simple design of the auxiliary drive can be achieved by designing the auxiliary drive as a hydraulic motor and by having a hydraulic pump driven by the power transfer unit drive the hydraulic motor. In this way, the energy of the auxiliary drive is thus supplied by the main drive.

By arranging a cooler in the pump circuit of the fluid of the shiftable fluid coupling, through which the fluid flows, excessive heating of the fluid can be prevented. This is a major advantage over non-shiftable, constantly filled fluid couplings, in which efficient cooling of the fluid used is not possible or only possible to a limited extent.

In order to enable the fluid level of the fluid inside the shiftable fluid coupling to be adjusted by varying the inflow and/or discharge of the fluid into and out of the shiftable fluid coupling accordingly, it can be provided that an interim storage tank for the fluid is arranged in the pump circuit of the fluid, in particular in the return flow of the fluid from the shiftable fluid coupling to the pump. If, for instance, the supply to the shiftable fluid coupling is interrupted, the fluid can drain out of the shiftable fluid coupling and is collected in the interim reservoir. In this way the shiftable fluid coupling can be drained. Accordingly, fluid can be removed from the interim reservoir and fed to the shiftable fluid coupling for filling the shiftable fluid coupling.

The problem addressed by the invention in relation to the method is solved by arranging a shiftable fluid coupling between the power transfer unit and the crusher, by reducing the fluid level of the fluid in the shiftable fluid coupling in the event of a blockage of the crusher and/or for starting the main drive, and by increasing the fluid level of the fluid while the crusher is ramped-up. Reducing the level can influence the transmission of torque and/or power of the shiftable fluid coupling. Draining the fluid from the shiftable fluid coupling can completely interrupt the transmission of torque and/or power. This permits the main drive, which can be a diesel engine, for instance, to be started and ramped up. Raising the fluid level inside the shiftable fluid coupling continuously increases its transmission of torque and/or power. This permits a smooth ramping-up of the crusher. In case the crusher is overloaded or blocked, the fluid can be quickly discharged from the shiftable fluid coupling. This reduces or interrupts the transmission of torque and/or power. This measure can prevent the main drive from stalling and prevents the main drive, the crusher or any other component from being damaged in case of a blockage. The shiftable fluid coupling thus performs the task of a known combination of a clutch and a constantly filled fluid coupling downstream thereof.

The invention is explained in greater detail below based on an exemplary embodiment shown in the drawings. In the Figures.

Figure 3:
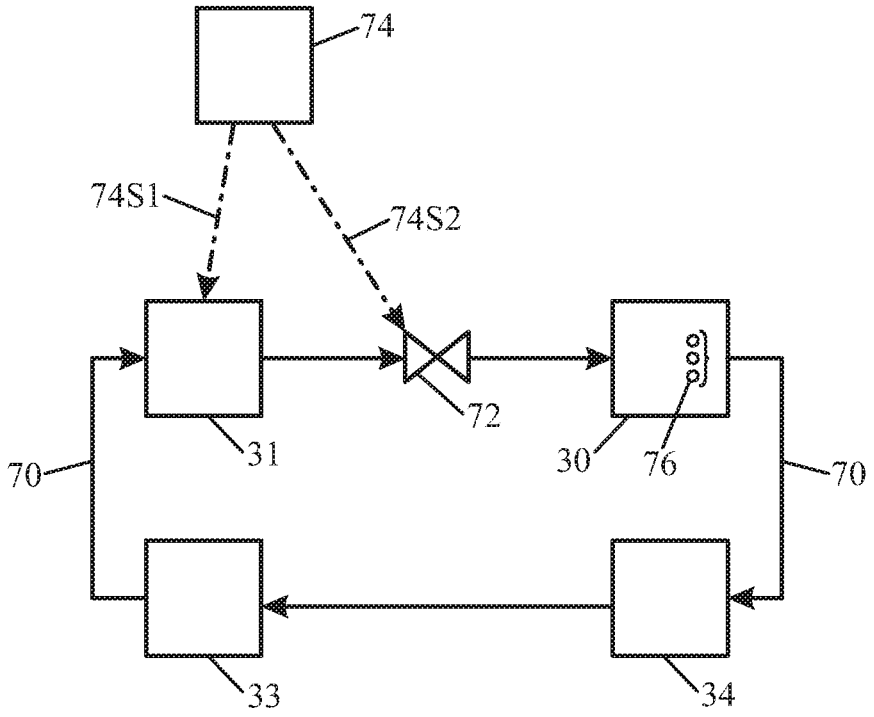

FIG. 3 schematically shows the pump circuit.

Figure 1:
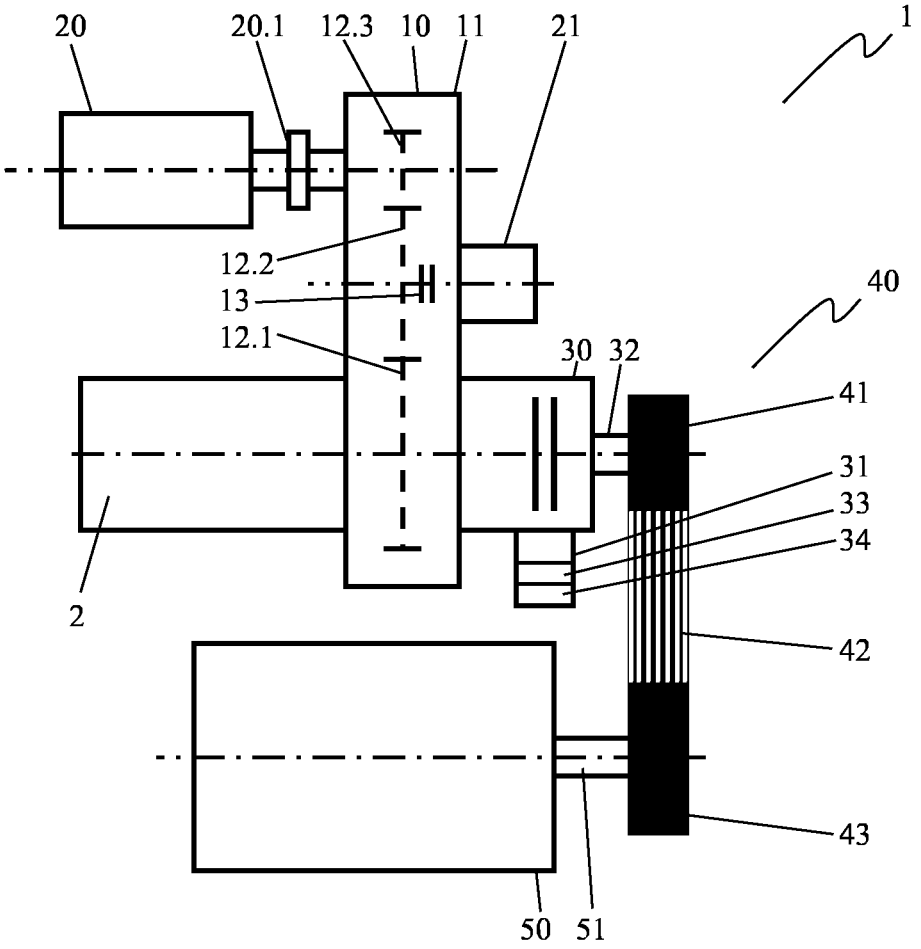
FIG. 1 shows a drive system for a crusher.

FIG. 1 shows a drive system 1 for a crusher 50. The crusher 50 is used for crushing material, especially rock material such as natural stone, concrete, bricks, building rubble and the like. It is designed as an impact crusher. However, it is also conceivable to provide other types of crushers, such as cone crushers, jaw crushers and the like.

The crusher 50 and drive system 1 are part of a mobile crushing plant not shown here. The crusher 50 is driven by a main drive 2. The latter is connected to a power transfer unit 10. The main drive 2 is coupled to a first gear wheel 12.1 of the power transfer unit 10 via a corresponding drive shaft. Further meshing gears 12.1, 12.2, 12.3 are arranged in a housing 11 of the power transfer unit 10. A first hydraulic pump 21 and a generator 20 are in this case driven by the power transfer unit 10. To this end, the first hydraulic pump 21 is connected to a second gear 12.2 of the power transfer unit 10 via a clutch 13. The generator 20 is connected to a third gear 12.3 of the power transfer unit 10 via a connecting element 20.1. The connecting element 20.1 may be a cardan shaft or a coupling.

A drive pulley 41 of a belt drive 40 is driven by the power transfer unit 10. There, a transmission ratio of one is specified in the transmission from the main drive 2 to the belt drive 40. A shiftable fluid coupling 30 is interposed in the path of transmission of torque and/or power from the power transfer unit 10 to the drive pulley 41. A pump 31 is assigned to the shiftable fluid coupling 30. The shiftable fluid coupling 30 and the pump 31 are interconnected in a pump circuit 70 schematically shown in FIG. 3 in a fluid conveying manner. A fluid is conveyed in the pump circuit. A cooler 33 is arranged in the pump circuit. In addition, an interim reservoir 34 is provided in the pump circuit to receive the fluid conveyed in the pump circuit. On the output side, an output shaft 32 is used to connect the shiftable fluid coupling 30 to the drive pulley 41.

The drive pulley 41 drives an output pulley 43 of the belt drive 40 via a drive belt 42. A shaft 51 connects the output pulley 43 to the crusher 50.

In this embodiment, the main drive 2 is a diesel engine. However, other kinds of engines or motors can also be provided, for instance an electric motor.

The shiftable fluid coupling is based on the Föttinger principle. The main drive 2 drives a pump wheel (not shown) of the shiftable fluid coupling 30 via the power transfer unit 10. The pump wheel conveys a fluid, preferably oil, to a turbine wheel of the shiftable fluid coupling 30 and drives the turbine wheel. The turbine wheel is connected to the output shaft 32. The turbine wheel thus drives the output shaft 32. The rotary motion of the output shaft 32 is transmitted to the output pulley 43 of the belt drive 40 via the drive pulley 41 and the drive belt 42. The belt drive drives the crusher 50 via the shaft 51.

The quantity of fluid in the shiftable fluid coupling 30 is not constant. It can be specifically adjusted. By changing the level of the fluid in the shiftable fluid coupling 30, its capacity for transmitting torque and/or power can be altered. When the shiftable fluid coupling 30 is completely or almost completely drained, it does not transmit torque and/or power. In that case, the crusher 50 is uncoupled from the main drive 2 and the power transfer unit 10. When the shiftable fluid coupling 30 is completely filled, torque and/or power can be transmitted at an efficiency in excess of 95%. In that case, the shiftable fluid coupling 30 has only little slippage. The capability of a partially filled shiftable fluid coupling 30 to transmit torque and/or power is limited. The higher the fluid level in the shiftable fluid coupling 30, the more power and/or torque the shiftable fluid coupling 30 can transmit without slippage or at only slight slippage. Due to the centrifugal forces, a fluid ring forms on the outside of the shiftable fluid coupling 30, which fluid ring drives the turbine wheel.

The pump 31 is designed as a gear pump in this case. However, it is also conceivable to use other types of pumps. Pump 31 delivers the fluid to the shiftable fluid coupling 30. Drilled holes 76 schematically shown in FIG. 3 are provided on the outer circumference of the shiftable fluid coupling 30. Due to the present centrifugal forces, the fluid continuously flows through the holes out of the shiftable fluid coupling 30. In case of a running main drive 2 and thus a running power transfer unit 10, the shiftable fluid coupling 30 is continuously drained. The pump 31 is designed such that it pumps more fluid into the shiftable fluid coupling 30 than fluid flows out through the drilled holes. The shiftable fluid coupling 30 can thus be filled by switching on the pump 31. Accordingly an emptying process of the shiftable fluid coupling 30 can be initiated by switching the pump 31 off.

In the exemplary embodiment shown, pump 31 is permanently connected to the power transfer unit 10 and driven by the latter when the main drive 2 is running. A valve 72 schematically shown in FIG. 3 is located in the pump circuit 70 between the outlet of pump 31 and the inlet of the shiftable fluid coupling 30. This valve can be used to interrupt or maintain the fluid flow to the shiftable fluid coupling 30. The valve is designed as a magnetic valve. It has two shift positions, namely an open and a closed position. When the valve is open, the shiftable fluid coupling 30 is filled and when the valve is closed, it is emptied owing to the discharge of fluid from the drilled holes of the shiftable fluid coupling 30. The interim reservoir 34 is used to hold the fluid discharged from the shiftable fluid coupling 30. Accordingly, when the valve is open, the fluid is taken from the interim reservoir 34 and pumped to the shiftable fluid coupling 30. A control unit 74 schematically shown in FIG. 3 is designed to detect an overload and/or a blockage of the crusher 50 and, in the event of a detected overload and/or blockage, to output a control signal 74S1 and/or 74S2, which causes the pump 31 to be switched off and/or the supply of fluid to the shiftable fluid coupling 30 to be interrupted by valve 72.

It is also conceivable to provide a proportional valve in the inlet of the shiftable fluid coupling 30 in the pump circuit in the place of the shifting valve. The proportional valve can be used to interrupt the fluid supply to the shiftable fluid coupling 30. It can also be used to continuously preset the volume flow of fluid supplied to the shiftable fluid coupling 30. In this way, a desired fluid level and thus a desired transmission behavior of the shiftable fluid coupling 30 can be adjusted.

Due to the high torques and/or power transmitted by the shiftable fluid coupling 30 and the associated high stress on the fluid, the fluid is heated considerably. In this way, its viscosity and thus its transmission properties are altered. According to the invention, the cooler 33 in the pump circuit can be directly or indirectly assigned to the fluid coupling. This causes the temperature of the fluid to remain inside a specified temperature range and thus does not fall below a specified viscosity. The transmission properties of the shiftable fluid coupling 30 are thus maintained. In particular, this cooler 33 can be designed as a separate unit. In addition to the fluid coupling 30, further assemblies to be cooled can also be connected thereto.

It is conceivable to design the shiftable fluid coupling 30 without the described drilled holes. The pump 31 can then suck the fluid from the shiftable fluid coupling 30. It is also conceivable to provide a separate fluid pump for pumping out the fluid. Valves can be provided both in the inlet and in the outlet of the shiftable fluid coupling to adjust the fluid level. The fluid level in the shiftable fluid coupling 30 can also be adjusted by controlling the pump 31 or the pump 31 in addition to the fluid pump in the return line accordingly.

The starting process of drive system 1 is performed as described below. First, the main drive 2 is started with an empty or nearly empty shiftable fluid coupling 30 and run up to a desired speed. The pump impeller of the shiftable fluid coupling 30 co-rotates therewith. If the shiftable fluid coupling 30 is coupled to the main drive 2 without an additional transmission ratio, as shown in the present exemplary embodiment, the pump impeller rotates at the same speed as the main drive 2. However, it is also conceivable to provide a transmission ratio other than 1 between the main drive 2 and the shiftable fluid coupling 30, such that both rotate at different speeds. The pump 31 is also driven by the power transfer unit 10 or directly by the main drive 2. The valve located between the pump 31 and the inlet of the fluid coupling 30 in the pumping circuit is closed, i.e. no fluid is pumped into the fluid coupling 30. After the main drive 2 has reached the desired speed, fluid is pumped into the shiftable fluid coupling 30. To do so, the valve is opened based on a corresponding control signal. Because the volume flow of fluid supplied to the shiftable fluid coupling 30 is greater than the discharged volume flow, the shiftable fluid coupling 30 is slowly filled. This increases the torque transmitted from the pump wheel to the turbine wheel. When the breakaway torque of the output drive train is reached, the turbine wheel and the associated output drive train start to rotate. The output train includes all moving components downstream of the output shaft 32. As the level rises, the turbine wheel is slowly accelerated to the speed of the pump wheel. As a result, the speed of the crusher 50 also increases slowly. If the speed of the pump and the turbine wheel are equal or at least approximately equal, the speed of the crusher 50 can be further increased by increasing the speed of the main drive 2.

In case of overload or blockage of the crusher 50, the level in the shiftable fluid coupling 30 is reduced. For this purpose, the valve provided between the pump 31 and the shiftable fluid coupling 30 is closed if a blockage or overload is detected. If there is no inflow of fluid, the shiftable fluid coupling 30 is drained. Even for only partially drained fluid, the transmission of torque and power of the shiftable fluid coupling 30 is significantly reduced. As a result, the blocked crusher 50 is protected shortly after the valve is closed. Slippage between the pump wheel and the turbine wheel is rendered possible, thereby partially decoupling the crusher 50 and the main drive 2. A blockage of the crusher 50 therefore no longer results in the main drive 2 stalling, even if the fluid is only partially drained. The shiftable fluid coupling 30 is designed such that it drains quickly when no fluid is supplied. As a result, the turbine wheel is decoupled from the pump wheel inside a short time.

The shiftable fluid coupling 30 therefore combines several functions in one component. It takes time until, owing to the rising fluid level and the high viscosity of the fluid, the inertial turbine wheel and the output drive coupled thereto are accelerated to the speed of the drive shaft 32 after the crusher 50 has been started. This effects a smooth start-up of the crusher 50. Furthermore, the driving components (main drive 2, input shaft, any torsional vibration couplings 3, 4 (see FIG. 2), power transfer unit 10, etc.) are treated more carefully, as, owing to the decoupling effect of the shiftable fluid coupling 30, they are not subjected to abrupt stresses due to the retroaction of the crusher 50. The shiftable fluid coupling 30 can interrupt the transmission of torque and/or power from the main drive 2 to the crusher 50. In this way, the main drive 2 can be started and ramped up. It also permits a quick decoupling of the main drive 2 from the crusher 50, for instance in case of a blockage or overload of the crusher 50. Damage to crusher 50 and drive system 1 can be avoided in that way.

Figure 2:
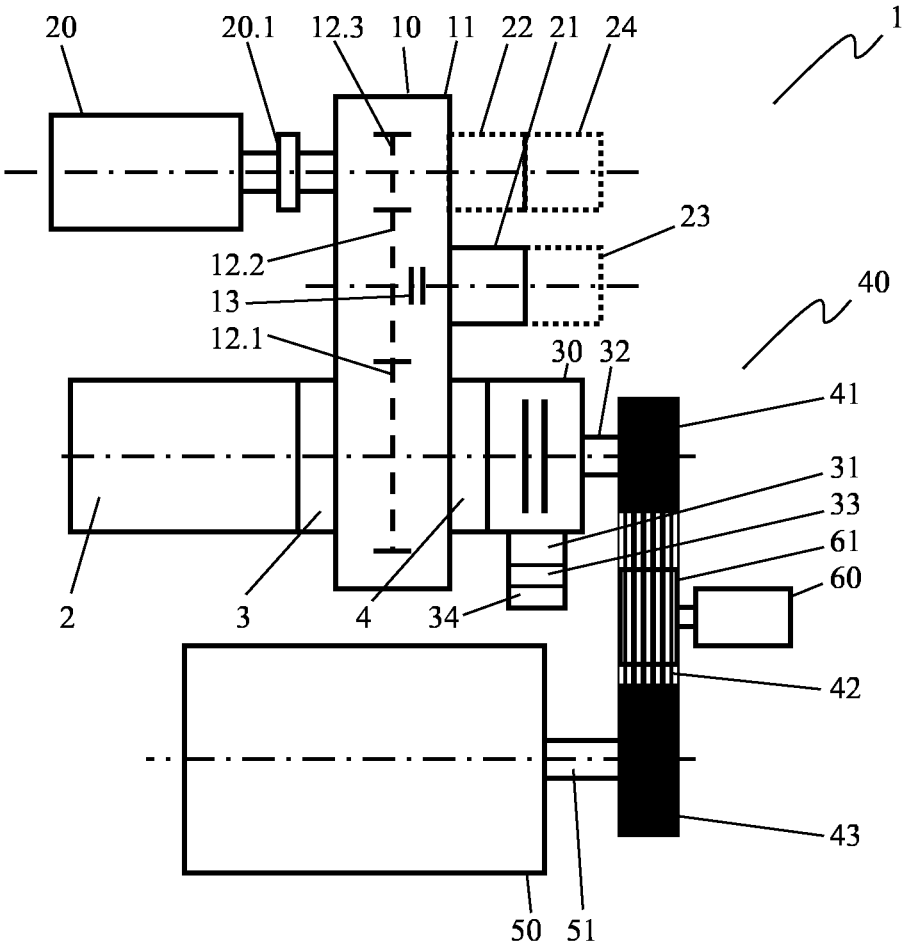
FIG. 2 shows the drive system shown in FIG. 1 having an additional auxiliary drive.

FIG. 2 shows drive system 1 shown in FIG. 1 having an additional auxiliary drive 60. In addition, compared to the drive system shown in FIG. 1, a second, third and fourth hydraulic pump 22, 23, 24 are connected to power transfer unit 10. The second and fourth hydraulic pumps 22, 24 are directly coupled to the third gear 12.3 of the power transfer unit 10, while the first and third hydraulic pumps 21, 23 are coupled to the second gear 12.2 of the power transfer unit 10 via the clutch 13, and can be switched on and off in that way. The main drive 2 and the shiftable fluid coupling 30 are each attached to the housing 11 of the power transfer unit 10 via the respective torsional vibration couplings 3, 4. The torsional vibration couplings 3, 4 have a damping effect in the circumferential direction and compensate for small offsets of the axle alignment.

The auxiliary drive 60 is designed as a hydraulic motor. In the exemplary embodiment shown, it is driven by the third hydraulic pump 23, which can be switched on and off. The auxiliary drive 60 can be switched on and off by actuating the clutch 13 accordingly. The auxiliary drive 60 acts on the drive belt 42 via a belt pulley 61 of the belt drive 40. When the shiftable fluid coupling 30 is uncoupled, the belt drive 40 and thus the crusher 50 connected to the belt drive 40 can thus be moved with the aid of the auxiliary drive 60. This permits the crusher 50 to be turned into a suitable maintenance position, for instance. The crusher 50 can also be rotated against its work-flow direction determined by the direction of rotation of the main drive 2. In that way, the crusher 50 can be unblocked, for instance. The auxiliary drive 60 can also be used to assist in ramping-up the crusher 50. For this purpose, the crusher 50 can be accelerated to a predetermined speed using the auxiliary drive 60 before and/or while the shiftable fluid coupling 30 is filled.

The invention claimed is:

1. A drive system for driving a crusher of a material crusher plant, comprising:

a main drive;

a power transfer unit driven by the main drive;

at least one generator driven by the power transfer unit:

a first hydraulic pump driven by the power transfer unit and connected to the power transfer unit in a shiftable manner;

a shiftable fluid coupling configured to be interposed in a path of power transmission from the power transfer unit to the crusher; and a further pump interconnected with the shiftable fluid coupling in a pump circuit such that the further pump supplies a flow of fluid to the shiftable fluid coupling.

2. The drive system of claim 1, wherein:

the shiftable fluid coupling is configured such that a transmission of power of the shiftable fluid coupling is adjustable by adjusting a filling quantity of the fluid in the shiftable fluid coupling.

3. The drive system of claim 2, wherein the drive system is configured such that:

in a first operating state a volume flow of fluid supplied to the shiftable fluid coupling is greater than a volume flow of fluid discharged from the shiftable fluid coupling;

in a second operating state the volume flow of fluid supplied to the shiftable fluid coupling is equal to the volume flow of fluid discharged from the shiftable fluid coupling; and in a third operating state the volume flow of fluid supplied to the shiftable fluid coupling is smaller than the volume flow of fluid discharged from the shiftable fluid coupling.

4. The drive system of claim 1, further comprising:

at least one valve arranged in the pump circuit to interrupt the flow of fluid to the shiftable fluid coupling.

5. The drive system of claim 1, wherein:

the further pump is driven by the power transfer unit or by a drive shaft of the main drive or by a shaft of the shiftable fluid coupling.

6. The drive system of claim 1, wherein:

the shiftable fluid coupling includes holes through which the fluid is routed out of the shiftable fluid coupling due to centrifugal force present inside the shiftable fluid coupling, the fluid subsequently being routed to the further pump.

7. The drive system of claim 6, wherein:

the further pump has a deliver rate greater than a volume flow through the holes of the shiftable fluid coupling caused by the centrifugal force.

8. The drive system of claim 1, further comprising:

a control unit configured to detect an overload or a blockage of the crusher, and in event of a detected overload or blockage to output a control signal configured to cause the further pump to be switched off and/or to cause the fluid supplied to the shiftable fluid coupling to be interrupted.

9. The drive system of claim 8, further comprising:

at least one valve arranged in the pump circuit to interrupt the flow of fluid to the shiftable fluid coupling;

wherein the control unit is configured to control the further pump and/or the at least one valve such that a filling quantity of the fluid in the shiftable fluid coupling increases when a rotational speed of the main drive is increased after a start of the main drive and/or when a rotational speed of the crusher is increased.

10. The drive system of claim 1, further comprising:

at least one second hydraulic pump connected to the power transfer unit in a non-shiftable manner, the at least one second hydraulic pump being driven by the power transfer unit.

11. The drive system of claim 1, further comprising:

a belt drive including a drive pulley connected to the shiftable fluid coupling, the belt drive being configured to connect the drive system to the crusher.

12. The drive system of claim 1, further comprising:

an auxiliary drive operatively connected with the drive system downstream of the shiftable fluid coupling, the auxiliary drive being configured to drive the crusher.

13. The drive system of claim 12, wherein:

the auxiliary drive includes a hydraulic motor, the hydraulic motor being driven by a hydraulic pump driven by the power transfer unit.

14. The drive system of claim 1, further comprising:

a cooler arranged in the pump circuit such that the fluid flows through the cooler.

15. The drive system of claim 1, further comprising:

an interim reservoir arranged in the pump circuit to receive return flow from the shiftable fluid coupling to the further pump.

16. A method of operating a crusher of a material crusher plant, the method comprising:

providing a material crusher plant having a drive system driving the crusher, the drive system including at least one main drive, a power transfer unit, and a shiftable fluid coupling arranged between the power transfer unit and the crusher;

reducing a fluid level of fluid in the shiftable fluid coupling in an event of a blockage of the crusher; and increasing the fluid level of fluid in the shiftable fluid coupling as a load on the crusher is increased.

17. The method of claim 16, further comprising:

reducing the fluid level of fluid in the shiftable fluid coupling for starting the main drive.

* * * * *